US006329081B1

(12) United States Patent
Fudanoki et al.

(10) Patent No.: US 6,329,081 B1
(45) Date of Patent: Dec. 11, 2001

(54) STAINLESS STEEL SHEET MATERIAL AND MANUFACTURING METHOD THEREOF

(75) Inventors: Fumio Fudanoki; Toshihiko Sugimoto; Satoshi Akamatsu, all of Hikari; Masanori Hashimoto, Tokyo, all of (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/572,604

(22) Filed: May 17, 2000

(30) Foreign Application Priority Data

Jul. 7, 1999 (JP) ..... 11-193284

(51) Int. Cl.[7] ..... C22C 38/06; C21D 8/00

(52) U.S. Cl. ..... 428/687; 72/41; 72/199; 148/609; 148/610; 148/621; 148/645; 148/651; 428/577; 428/685; 428/927

(58) Field of Search ..... 428/687, 577, 428/685, 927; 148/609, 610, 621, 645, 651; 72/41, 199

(56) References Cited

U.S. PATENT DOCUMENTS 5,820,704 * 10/1998 Veyer et al. ..... 148/610
5,976,282 * 11/1999 Fukuda et al. ..... 148/609

FOREIGN PATENT DOCUMENTS 3-207807 9/1991 (JP) .
3-226517 10/1991 (JP) .

* cited by examiner

*Primary Examiner*—Robert R. Koehler
(74) *Attorney, Agent, or Firm*—Kenyon & Kenyon

(57) ABSTRACT

There is provided a stainless steel sheet material, used for a semiconductor manufacturing device, to which it difficult for fine dust to be attached and from the surface of which the attaching dust can be easily washed away. Also, there is provided a method of manufacturing the stainless steel sheet material. A stainless steel sheet material characterized in that: the number of pinholes, the area of each pinhole exceeding 0.25 $mm^2$, in the area of 10 $cm^2$ on the surface of a skinpass-rolled stainless steel sheet material is not more than 10; and the average surface roughness Ra on the center line in the direction perpendicular to the rolling direction is not more than 0.15 $\mu$m. A method of manufacturing a stainless steel sheet material comprising the steps of: annealing a stainless steel cold-rolled sheet in a heat-treatment furnace having no support rollers in a temperature region exceeding 600° C. in a reducing atmosphere; and conducting skinpass rolling on the annealed stainless steel sheet material with a water soluble lubricant so that the average surface roughness Ra on the center line in the direction perpendicular to the rolling direction is not more than 0.15 $\mu$m.

6 Claims, No Drawings

STAINLESS STEEL SHEET MATERIAL AND MANUFACTURING METHOD THEREOF

BACKGROUND OF THE INVENTION

1. Field of the Invention

The present invention relates to a surface-finished stainless steel sheet used for a case and parts of a semiconductor manufacturing device, onto which it is difficult for fine dust to attach and, even if fine dust attaches onto the surface of the stainless steel sheet, the fine dust can be easily removed by cleaning.

2. Description of the Related Art

When the parts of a semiconductor manufacturing device are made, a stainless steel sheet, the surface of which is finished to grade 2B stipulated by JIS, or a stainless steel sheet, the surface of which is polished, has been commonly used.

Conventionally, the stainless steel sheet, the surface of which is finished to grade 2B stipulated by JIS, is manufactured as follows. A cold-rolled stainless steel sheet is annealed and descaled by a continuous heat-treating and acid-cleaning line. After that, the stainless steel sheet is rolled by a skinpass rolling mill so that the material can be adjusted and the profile can be reformed. A surface-polished stainless steel sheet is manufactured as follows. Usually, a stainless steel sheet, the surface of which has already been finished to grade 2B, is used, and it is made to come into contact with a polishing face of a polishing belt or a polishing disk which are being rotated.

However, when a stainless steel sheet, the surface of which is finished to grade 2B, or the surface-polished stainless steel sheet, is used for making the parts of a semiconductor manufacturing device, the following problems may be encountered. Fine dust floating in air tends to attach onto the surface of the stainless steel sheet, and further it is difficult to remove the attached fine dust by wiping and cleaning. Therefore, the manufacturing yield is deteriorated in the manufacturing process by the thus attached fine dust. The reason why fine dust attaches onto the surface of the stainless steel sheet, the surface of which is finished to grade 2B, or the surface of the surface-polished stainless steel sheet is that small dents are formed on the surface, the diameters of which are 0.1 to 0.9 mm, which cause no problems in the case of manufacturing building materials or kitchen devices to which the stainless steel sheet is conventionally applied. The above small dents will be referred to as pinholes, hereinafter.

It is assumed that these pinholes are created and remain on the surface of the stainless steel sheet as follows.

(1) When the stainless steel sheet, the surface of which is finished to grade 2B, is manufactured by the aforementioned manufacturing method, in the continuous annealing and acid-cleaning line in which the cold-rolled steel sheet is continuously annealed and acid-cleaned, the stainless steel strip comes into contact with support rollers for supporting and carrying the stainless steel strip of high temperature in the heat-treatment furnace. Therefore, foreign objects (buildup) attaching onto the support rollers create small dents when the foreign objects are pushed into the surface of the stainless steel strip.

(2) After the continuous annealing and acid-cleaning has been completed, the stainless steel strip is rolled by a skinpass rolling mill so that the material can be adjusted and the profile can be reformed. In the process of skinpass rolling, the rolling is conventionally conducted under the condition of no lubricant, because it is necessary to keep the surface brightness of the stainless steel strip. Therefore, foreign objects attaching onto the work roller or foreign objects carried on the surface of the stainless steel strip create small dents on the surface of the stainless steel strip when the stainless steel strip comes into contact with the work rollers of the skinpass rolling mill.

(3) Further, when the polished stainless steel sheet is manufactured, the stainless steel sheet, the surface of which is finished to grade 2B, is polished as described above. In this case, the surface roughness is suppressed to be #100 to #400 from the viewpoint of ensuring the cleaning property. Therefore, the polishing allowance to be removed by polishing is small. Accordingly, pinholes created in the process of continuous annealing and acid-cleaning and also in the process of skinpass rolling cannot be removed by polishing so that they remain on the surface of the stainless steel strip.

In order to prevent the creation of these pinholes, for example, as disclosed by JP-A-3-207807 and JP-A-3-226517, there is proposed a method of solving the problems of buildup on the support roller in the continuous annealing furnace, by which the surface of the support roller is coated by cermet by means of flame coating so that the resistance to buildup on the surface of the support roller can be improved. However, the above method of coating the surface with cermet is very high expensive, which raise the production cost, and further it is difficult to keep the roller surface uniform and furthermore it is difficult to extend the life of the roller.

Concerning the method of removing the buildup on the work roller of the skinpass rolling mill, there is proposed a brush type roller cleaner for removing the foreign objects attaching on the work roller surface, and further there is proposed a vacuum cleaner in order to remove the foreign object which have been carried being attached onto the surface of the stainless steel strip. However, even if the above methods are adopted, it is difficult to effectively remove the foreign objects creating pinholes, the diameters of which are 0.1 to 0.9 mm, which cause problems in the manufacturing process of a semiconductor device.

SUMMARY OF THE INVENTION

It is an object of the present invention to provide a stainless steel sheet material, used for a semiconductor manufacturing device, capable of solving the above problems in the prior art.

The present inventors made investigation into a mechanism by which the pinholes are created and remain on the surface of the stainless steel sheet, the surface of which is finished to grade 2B, or the surface of which is polished. As a result of the investigation, they invented a stainless steel sheet material used for a semiconductor manufacturing device which can be made at low cost by putting the present apparatus to good use. Further, they invented a manufacturing method of manufacturing the stainless steel sheet material.

The summary of the present invention will be described as follows.

(1) The number of pinholes, the area of each pinhole exceeding 0.25 $mm^2$, in the area of 10 $cm^2$ on the surface of a skinpass-rolled stainless steel sheet material is not more than 10, and the average surface roughness Ra on the center line in the direction perpendicular to the rolling direction is not more than 0.15 $\mu$m.

(2) A stainless steel cold-rolled sheet is annealed in a heat-treatment furnace, having no support rollers, in a temperature region exceeding 600° C. in a reducing atmosphere, and skinpass rolling is conducted on the annealed stainless steel sheet material with a water soluble lubricant so that the average surface roughness Ra on the center line in the direction perpendicular to the rolling direction is not more than 0.15 μm.

(3) The number of pinholes, the area of one pinhole exceeding 0.25 $mm^2$, existing in the area of 10 $cm^2$ on the surface of the polished stainless steel sheet material is not more than 10, and the average surface roughness Ra on the center line in the direction perpendicular to the polishing direction is not more than 0.30 μm.

(4) A stainless steel cold-rolled sheet is annealed in a heat-treatment furnace having no support rollers in a temperature region exceeding 600° C. in a reducing atmosphere, skinpass rolling is conducted on the annealed stainless steel sheet material with a water soluble lubricant, and polishing is mechanically conducted so that the average surface roughness Ra on the center line in the direction perpendicular to the polishing direction is not more than 0.30 μm.

(5) Polishing is mechanically conducted on a stainless steel cold-rolled sheet so that the average surface roughness Ra on the center line in the direction perpendicular to the polishing direction is not more than 0.30 μm, annealing is conducted on the stainless steel cold-rolled sheet in a heat-treatment furnace having no support rollers in a temperature region exceeding 600° C. in a reducing atmosphere, and skinpass rolling is conducted on the annealed stainless steel cold-rolled sheet material with a water soluble lubricant.

(6) A stainless steel sheet material containing Al by not less than 0.01 wt % and not more than 0.20 wt % is used in one of the above items (1) to (5).

DESCRIPTION OF THE PREFERRED EMBODIMENT

First, the surface condition of a stainless steel sheet material used for a semiconductor manufacturing device will be explained below.

The present inventors made various investigations into the condition of pinholes on the surface of a stainless steel sheet material used for a semiconductor manufacturing device onto which it is difficult for fine dust floating in air to attach. As a result of the investigations, they discovered that the following condition is effective. The number of pinholes, the area of each pinhole exceeding 0.25 $mm^2$, existing in the area of 10 $cm^2$ on the surface of the skinpass-rolled stainless steel sheet material is not more than 10.

Also, the present inventors made various investigations into the condition of roughness on the surface of a stainless steel sheet material used for a semiconductor manufacturing device by which it becomes easy to remove fine dust, which attaches onto the surface of the stainless steel sheet material, in the process of cleaning. As can be seen in the examples of the present invention shown on Table 1, the present inventors discovered that it is effective to keep the average surface roughness Ra on the center line in the direction perpendicular to the rolling direction on the surface of the skinpass-rolled steel sheet at a value not more than 0.15 μm.

Next, a method of manufacturing a stainless steel sheet material used for a semiconductor manufacturing device will be explained below.

In order to obtain the above condition of the surface, a stainless steel cold-rolled sheet is annealed in a heat-treatment furnace having no support rollers in a temperature region exceeding 600° C. in a reducing atmosphere, and skinpass rolling is conducted on the annealed stainless steel sheet material with a water soluble lubricant so that the average surface roughness Ra on the center line in the direction perpendicular to the rolling direction cannot be more than 0.15 μm.

Concerning the annealing condition, when a stainless steel cold-rolled sheet is annealed in a heat-treatment furnace having support rollers in a temperature region exceeding 600° C., the stainless steel cold-rolled sheet is recovered in the temperature region exceeding 600° C., so that it is softened. Accordingly, foreign objects (buildup) attaching onto the surfaces of the support rollers tend to be pushed onto the surface of the stainless steel cold-rolled sheet. As a result, there is a tendency that pinholes are created which cause problems in the process of making a semiconductor manufacturing device. For the above reasons, annealing is conducted in a heat-treatment furnace having no support rollers in the temperature region exceeding 600° C. It is preferable to use a heat-treatment furnace having no support rollers in the temperature region exceeding 500° C.

When annealing is conducted in a heat-treatment furnace having no reducing atmosphere gas in it, pinholes tend to be more created because foreign objects, which are oxide scale generated in the process of annealing the cold-rolled steel sheet, attach onto the surface of the support roller. Accordingly, annealing is conducted in a heat-treatment furnace having a reducing atmosphere gas in it. It is preferable to use a reducing atmosphere gas in which hydrogen and nitrogen are mixed with each other by the ratio of $H_2$:$N_2$=(1 to 9):1.

When skinpass rolling is conducted with water soluble lubricant, foreign objects attaching to the work roller surface are always washed away and removed. Therefore, the formation of buildup on the work roller surface is suppressed. Since the foreign objects attaching to the steel strip surface are washed away and removed before they enter the entrance of the roller bite at which the work roller and the steel strip come into contact with each other, pinholes are seldom created in the process of skinpass rolling. The reason why the water soluble lubricant is effective for removing the foreign objects is unknown, however, it is assumed that water soluble lubrication has a higher effect for removing the foreign objects than oil lubrication.

A surface, the average roughness Ra on the center line in the direction perpendicular to the rolling direction of which is not more than 0.15 μm, can be obtained in such a manner that the surfaces of the work rollers of skinpass rolling are ground by a grinding wheel so that the predetermined surface roughness can be obtained, and skinpass rolling is conducted with the thus ground work rollers.

Next, the condition of polishing the surface of the stainless steel material used for the semiconductor manufacturing device will be explained below.

The present inventors made various investigations into the surface roughness by which fine dust attached onto the surface of the stainless steel material used for the semiconductor manufacturing device can be easily removed in the process of washing. As a result of the investigations, they discovered the following. As can be seen in the examples shown on Table 2, it is effective that the average roughness Ra on the center line in the direction perpendicular to the rolling direction is not more than 0.30 μm on the surface of the stainless steel sheet after the polishing has been completed.

The manufacturing method for obtaining the above surface condition will be explained below.

In order to obtain the above surface condition, a stainless steel cold-rolled sheet is annealed in a reducing atmosphere in a heat-treatment furnace having no support rollers in a temperature region exceeding 600° C., skinpass rolling is conducted on the annealed stainless steel sheet material with a water soluble lubricant, and polishing is mechanically conducted so that the average surface roughness Ra on the center line in the direction perpendicular to the polishing direction is not more than 0.30 $\mu$m.

Alternatively, polishing is mechanically conducted on a stainless steel cold-rolled sheet so that the average surface roughness Ra on the center line in the direction perpendicular to the polishing direction is not more than 0.30 $\mu$m, annealing is conducted on the stainless steel cold-rolled sheet in a reducing atmosphere in a heat-treatment furnace having no support rollers in a temperature region exceeding 600° C., and skinpass rolling is conducted on the annealed stainless steel cold-rolled sheet material with a water soluble lubricant.

The reasons why the annealing and the skinpass rolling condition are restricted have already been described.

The polished stainless steel sheet is used from the viewpoint of improving the appearance of the device. When the stainless steel sheet is polished, fine dust attaching to the surface of the stainless steel sheet can be easily washed away compared with the surface of the stainless steel sheet which has been left as it is after the completion of skinpass rolling. The reason is unknown, however, it is assumed that when fine grooves are formed in a direction in the process of polishing, the pinholes are effectively filled with the washing liquid for removing fine dust attached inside the pinholes.

The reason why Al is restricted as a chemical component contained in the stainless steel sheet will be explained below.

When Al content is not less than 0.01%, Al oxide is created on the oxide film of Cr. Therefore, the surface layer is hardened, and it becomes difficult for the foreign objects to be pushed into the oxide film, which is advantageous for preventing the creation of pinholes. However, when Al content exceeds 0.20%, a quantity of Al oxide is remarkably increased, which could be a cause of the creation of surface defects and the buildup onto the support rollers is facilitated. Accordingly, it is preferable that Al content of the stainless steel sheet is not lower than 0.01% and not more than 0.20%.

EXAMPLE 1

Next, the superiority of the present invention will be specifically explained referring to examples of the present invention and comparative examples.

The examples of the present invention, the comparative examples and the conventional examples are shown on Tables 1 and 2. Concerning the materials, stainless steel sheets of SUS304 and SUS430 were used. The chemical compositions, annealing conditions, skinpass-rolling conditions, polishing conditions and surface conditions are shown in the tables. The number of pinholes, the area of each pinhole exceeding 0.25 $mm^2$, was found by making measurement in a visual field corresponding to the area of 10 $cm^2$ of the surface of the stainless steel sheet with an image analysis device connected to an optical microscope.

Surface roughness was found with a tracer method type roughness meter. Resistance to dust was evaluated by an exposure test in which the test pieces were put in a clean room used for manufacturing semiconductors for three months and then the test pieces were collected and the surfaces were observed by a scanning type electron microscope.

The evaluation was conducted by classifying the results of observation into three steps of ◎>○>x. The steps not less than ○ were determined to be good. The washing property was evaluated as follows. The test pieces, which had gone through the exposure test, were used. These test pieces were wiped once with pieces of cloth dipped in a neutral detergent and then dried. After that, the surfaces of the test pieces were observed with a scanning type electron microscope, and the results of observation were evaluated. This evaluation was made by the same criterion as that of the evaluation of resistance to dust.

As can be seen on Tables 1 and 2, in the examples of the present invention, the number of pinholes, the area of each pinhole exceeding 0.25 $mm^2$, in the area of 10 $cm^2$ on the surface of the skinpass-rolled stainless steel sheet material is not more than 10, and the average surface roughness Ra on the center line in the direction perpendicular to the rolling direction is not more than 0.15 $\mu$m. Also, in the examples of the present invention, the number of pinholes, the area of each pinhole exceeding 0.25 $mm^2$, in the area of 10 $cm^2$ on the surface of the polished stainless steel sheet material is not more than 10, and the average surface roughness Ra on the center line in the direction perpendicular to the polishing direction is not more than 0.30 $\mu$m.

Accordingly, the examples of the present invention provide surface-finished stainless steel sheets preferably used for making a case and parts of a semiconductor manufacturing device, to which it is difficult for fine dust to attach and from which fine dust can be easily washed away.

TABLE 1

| | | | Base metal condition | | Annealing condition | | | | Skinpass rolling condition | | | Surface condition of steel sheet | | | |
|---|---|---|---|---|---|---|---|---|---|---|---|---|---|---|---|
| Number | Classification | Type of steel (SUS) | Wall thickness (mm) | Composition Al (%) | Support roller temperature*1 (° C.) | Annealing atmosphere*2 | Temperature (° C.) | Acid cleaning | Lubricant | Elongation ratio (%) | Roller surface roughness Ra (μm) | Number of pinholes (piece) | Average roughness Ra (μm) | Resistance to dust | Washing property |
| 1 | Present invention | 304 | 1.0 | 0.003 | 300 | Reducing | 1060 | No | Water soluble | 0.5 | 0.05 | 2 | 0.05 | ◎ | ◎ |
| 2 | Present invention | 304 | 1.5 | 0.003 | 400 | Reducing | 1080 | " | Water soluble | 0.5 | 0.05 | 4 | 0.05 | ◎ | ◎ |
| 3 | Present invention | 304 | 1.5 | 0.003 | 400 | Reducing | 1080 | " | Water soluble | 0.8 | 0.05 | 7 | 0.05 | ○ | ◎ |
| 4 | Present invention | 304 | 1.5 | 0.003 | 500 | Reducing | 1100 | " | Water soluble | 0.8 | 0.05 | 9 | 0.05 | ○ | ◎ |
| 5 | Present invention | 304 | 2.0 | 0.003 | 550 | Reducing | 1100 | " | Water soluble | 1.2 | 0.05 | 10 | 0.05 | ○ | ◎ |
| 6 | Comparative example | 304 | 2.0 | 0.003 | 650 | Reducing | 1120 | " | Water soluble | 0.8 | 0.05 | 18 | 0.05 | x | ◎ |
| 7 | Comparative example | 304 | 2.0 | 0.003 | 700 | Reducing | 1150 | " | Water soluble | 0.8 | 0.05 | 23 | 0.05 | x | ◎ |
| 8 | Comparative example | 304 | 1.5 | 0.003 | 400 | Reducing | 1100 | " | Oiliness | 0.8 | 0.05 | 12 | 0.05 | x | ◎ |
| 9 | Comparative example | 304 | 1.5 | 0.003 | 400 | Reducing | 1100 | " | No lubrication | 0.8 | 0.05 | 15 | 0.05 | x | ◎ |
| 10 | Comparative example | 304 | 1.5 | 0.003 | 400 | Reducing | 1100 | " | No lubrication | 0.8 | 0.05 | 20 | 0.05 | x | ◎ |
| 11 | Present invention | 304 | 1.5 | 0.003 | 400 | Reducing | 1080 | " | Water soluble | 0.8 | 0.02 | 5 | 0.02 | ◎ | ◎ |
| 12 | Present invention | 304 | 1.5 | 0.003 | 400 | Reducing | 1080 | " | Water soluble | 0.8 | 0.05 | 6 | 0.05 | ◎ | ◎ |
| 13 | Present invention | 304 | 1.5 | 0.003 | 400 | Reducing | 1080 | " | Water soluble | 0.8 | 0.10 | 4 | 0.10 | ◎ | ◎ |
| 14 | Present invention | 304 | 1.5 | 0.003 | 400 | Reducing | 1080 | " | Water soluble | 0.8 | 0.15 | 5 | 0.15 | ◎ | ○ |

TABLE 1-continued

| | | | Base metal condition | | Annealing condition | | | | Skinpass rolling condition | | | Surface condition of steel sheet | | | |
|---|---|---|---|---|---|---|---|---|---|---|---|---|---|---|---|
| Number | Classification | Type of steel (SUS) | Wall thickness (mm) | Composition Al (%) | Support roller temperature*1 (° C.) | Annealing atmosphere*2 | Temperature (° C.) | Acid cleaning | Lubricant | Elongation ratio (%) | Roller surface roughness Ra (μm) | Number of pinholes (piece) | Average roughness Ra (μm) | Resistance to dust | Washing property |
| 15 | Comparative example | 304 | 1.5 | 0.003 | 400 | Reducing | 1080 | " | Water soluble | 0.8 | 0.20 | 5 | 0.20 | ◎ | x |
| 16 | Comparative example | 304 | 1.5 | 0.003 | 400 | Reducing | 1100 | " | Water soluble | 0.8 | 0.25 | 7 | 0.25 | ○ | x |
| 17 | Present invention | 304 | 1.5 | 0.030 | 400 | Reducing | 1080 | " | Water soluble | 0.8 | 0.05 | 4 | 0.05 | ◎ | ◎ |
| 18 | Present invention | 304 | 1.5 | 0.070 | 400 | Reducing | 1080 | " | Water soluble | 0.8 | 0.05 | 2 | 0.05 | ◎ | ◎ |
| 19 | Comparative example | 304 | 1.5 | 0.300 | 400 | Reducing | 1080 | " | Water soluble | 0.8 | 0.05 | 26 | 0.05 | x | ◎ |
| 20 | Present invention | 430 | 1.5 | 0.070 | 350 | Reducing | 850 | " | Water soluble | 1.5 | 0.05 | 5 | 0.05 | ◎ | ◎ |
| 21 | Conventional example | 304 | 1.5 | 0.003 | 1100 | Oxidizing | 1100 | Done | Water soluble | 0.8 | 0.05 | 43 | 0.05 | x | ◎ |
| 22 | Conventional example | 430 | 1.5 | 0.003 | 850 | Oxidizing | 850 | " | Water soluble | 1.5 | 0.05 | 37 | 0.05 | x | ◎ |

*1Support roller temperature: Maximum temperature at which material comes into contact with the support rollers.
*2Annealing atmosphere: Reducing atmosphere $H_2$:$N_2$ = 3:1 Oxidizing atmosphere is the air.
Underlined numbers are out of the scope of the present invention.

TABLE 2

| | | | Base metal condition | | Annealing condition | | | | Skinpass rolling condition | | Polishing condition | | Surface condition of steel sheet | | | |
|---|---|---|---|---|---|---|---|---|---|---|---|---|---|---|---|---|
| Number | Classification | Type of steel (SUS) | Wall thickness (mm) | Composition Al (%) | Support roller temperature*1 (° C.) | Annealing atmosphere*2 | Temperature (° C.) | Acid cleaning | Lubricant | Elongation ratio (%) | Polishing process | Number of roughness of polishing wheel | Number of pinholes (piece) | Average roughness Ra (μm) | Resistance to dust | Washing property |
| 1 | Present invention | 304 | 1.0 | 0.003 | 300 | Reducing | 1060 | No | Water soluble | 0.5 | After skinpass rolling | #400 | 2 | 0.15 | ◎ | ◎ |
| 2 | Present invention | 304 | 1.5 | 0.003 | 400 | Reducing | 1080 | " | Water soluble | 0.5 | After skinpass rolling | #400 | 4 | 0.15 | ◎ | ◎ |
| 3 | Present invention | 304 | 1.5 | 0.003 | 400 | Reducing | 1080 | " | Water soluble | 0.8 | After skinpass rolling | #400 | 7 | 0.15 | ○ | ◎ |
| 4 | Present invention | 304 | 1.5 | 0.003 | 500 | Reducing | 1100 | " | Water soluble | 0.8 | After skinpass rolling | #400 | 9 | 0.15 | ○ | ◎ |
| 5 | Present invention | 304 | 2.0 | 0.003 | 550 | Reducing | 1100 | " | Water soluble | 1.2 | After skinpass rolling | #400 | 10 | 0.15 | ○ | ◎ |
| 6 | Comparative example | 304 | 2.0 | 0.003 | 650 | Reducing | 1120 | " | Water soluble | 0.8 | After skinpass rolling | #400 | 18 | 0.15 | x | ◎ |
| 7 | Comparative example | 304 | 2.0 | 0.003 | 700 | Reducing | 1150 | " | Water soluble | 0.8 | After skinpass rolling | #400 | 23 | 0.15 | x | ◎ |
| 8 | Comparative example | 304 | 1.5 | 0.003 | 400 | Reducing | 1100 | " | Oiliness | 0.8 | After skinpass rolling | #400 | 12 | 0.15 | x | ◎ |
| 9 | Comparative example | 304 | 1.5 | 0.003 | 400 | Reducing | 1100 | " | No lubrication | 0.8 | After skinpass rolling | #400 | 15 | 0.15 | x | ◎ |
| 10 | Comparative example | 304 | 1.5 | 0.003 | 400 | Reducing | 1100 | " | No lubrication | 0.8 | After skinpass rolling | #400 | 20 | 0.15 | x | ◎ |
| 11 | Present invention | 304 | 1.5 | 0.003 | 400 | Reducing | 1080 | " | Water soluble | 0.8 | After skinpass rolling | #800 | 5 | 0.05 | ◎ | ◎ |
| 12 | Present invention | 304 | 1.5 | 0.003 | 400 | Reducing | 1080 | " | Water soluble | 0.8 | After skinpass rolling | #600 | 6 | 0.10 | ◎ | ◎ |
| 13 | Present invention | 304 | 1.5 | 0.003 | 400 | Reducing | 1080 | " | Water soluble | 0.8 | After skinpass rolling | #200 | 4 | 0.20 | ◎ | ◎ |

TABLE 2-continued

| Number | Classification | Type of steel (SUS) | Base metal condition: Wall thickness (mm) | Base metal condition: Composition Al (%) | Annealing condition: Support roller temperature*1 (° C.) | Annealing condition: Annealing atmosphere*2 | Annealing condition: Temperature (° C.) | Acid cleaning | Skinpass rolling condition: Lubricant | Skinpass rolling condition: Elongation ratio (%) | Polishing condition: Polishing process | Polishing condition: Number of roughness of polishing wheel | Surface condition of steel sheet: Number of pinholes (piece) | Surface condition of steel sheet: Average roughness Ra (μm) | Resistance to dust | Washing property |
|---|---|---|---|---|---|---|---|---|---|---|---|---|---|---|---|---|
| 14 | Present invention | 304 | 1.5 | 0.003 | 400 | Reducing | 1080 | " | Water soluble | 0.8 | After skinpass rolling | #100 | 4 | 0.30 | ◎ | ○ |
| 15 | Comparative example | 304 | 1.5 | 0.003 | 400 | Reducing | 1080 | " | Water soluble | 0.8 | After skinpass rolling | #80 | 2 | 0.40 | ◎ | x |
| 16 | Comparative example | 304 | 1.5 | 0.003 | 400 | Reducing | 1100 | " | Water soluble | 0.8 | After skinpass rolling | #60 | 3 | 0.80 | ◎ | x |
| 17 | Present invention | 304 | 1.5 | 0.030 | 400 | Reducing | 1080 | " | Water soluble | 0.8 | After skinpass rolling | #400 | 4 | 0.15 | ◎ | ◎ |
| 18 | Present invention | 304 | 1.5 | 0.070 | 400 | Reducing | 1080 | " | Water soluble | 0.8 | After skinpass rolling | #400 | 2 | 0.15 | ◎ | ◎ |
| 19 | Comparative example | 304 | 1.5 | 0.300 | 400 | Reducing | 1080 | " | Water soluble | 0.8 | After skinpass rolling | #400 | 23 | 0.15 | x | ◎ |
| 20 | Present invention | 430 | 1.5 | 0.070 | 400 | Reducing | 850 | " | Water soluble | 1.5 | After skinpass rolling | #400 | 5 | 0.15 | ◎ | ◎ |
| 21 | Present invention | 304 | 1.5 | 0.003 | 400 | Reducing | 1080 | " | Water soluble | 0.8 | Before annealing | #400 | 9 | 0.15 | ○ | ◎ |
| 22 | Conventional example | 304 | 1.5 | 0.003 | 1100 | Oxidizing | 1100 | Done | Water soluble | 0.8 | After skinpass rolling | #400 | 40 | 0.15 | x | ◎ |
| 23 | Conventional example | 430 | 1.5 | 0.003 | 850 | Oxidizing | 850 | " | Water soluble | 1.5 | After skinpass rolling | #400 | 35 | 0.15 | x | ◎ |

*1 Support roller temperature: Maximum temperature at which material comes into contact with the support rollers.
*2 Annealing atmosphere: Reducing atmosphere $H_2$:$N_2$ = 3:1 Oxidizing atmosphere is the air.
Underlined numbers are out of the scope of the present invention.

What is claimed is:

1. A stainless steel sheet material characterized in that: said stainless steel sheet material contains Al at not less than 0.01 wt. % and not more than 0.20 wt. % and the number of pinholes, the area of each pinhole exceeding 0.25 $mm^2$, in the area of 10 $cm^2$ on the surface of a skinpass-rolled stainless steel sheet material is not more than 10; and the average surface roughness Ra on the center line in the direction perpendicular to the rolling direction is not more than 0.15 $\mu$m.

2. A stainless steel sheet material characterized in that: said stainless steel sheet material contains Al at not less than 0.01 wt. % and not more than 0.20 wt. % and the number of pinholes, the area of each pinhole exceeding 0.25 $mm^2$, in the area of 10 $cm^2$ on the surface of a polished stainless steel sheet material is not more than 10; and the average surface roughness Ra on the center line in the direction perpendicular to the polishing direction is not more than 0.30 $\mu$m.

3. A method of manufacturing a stainless steel sheet material comprising the steps of: annealing a stainless steel cold-rolled sheet in a heat-treatment furnace having no support rollers in a temperature region exceeding 600° C. in a reducing atmosphere; and conducting skinpass rolling on the annealed stainless steel sheet material with a water soluble lubricant so that the average surface roughness Ra on the center line in the direction perpendicular to the rolling direction is not more than 0.15 $\mu$m.

4. A method of manufacturing a stainless steel sheet material according to claim 3, wherein the stainless steel sheet material contains Al at not less than 0.01 wt % and not more than 0.20 wt %.

5. A method of manufacturing a stainless steel sheet material comprising the steps of: annealing a stainless steel cold-rolled sheet in a heat-treatment furnace having no support rollers in a temperature region exceeding 600° C. in a reducing atmosphere; conducting skinpass rolling on the annealed stainless steel sheet material with a water soluble lubricant; and polishing mechanically so that the average surface roughness Ra on the center line in the direction perpendicular to the polishing direction is not more than 0.30 $\mu$m.

6. A method of manufacturing a stainless steel sheet material comprising the steps of: polishing mechanically a stainless steel cold-rolled sheet so that the average surface roughness Ra on the center line in the direction perpendicular to the polishing direction is not more than 0.30 $\mu$m; annealing the stainless steel cold-rolled sheet in a heat-treatment furnace having no support rollers in a temperature region exceeding 600° C. in a reducing atmosphere; and conducting skinpass rolling on the annealed stainless steel cold-rolled sheet material with a water soluble lubricant.

* * * * *